US006949711B1

(12) United States Patent
Litteer

(10) Patent No.: US 6,949,711 B1
(45) Date of Patent: Sep. 27, 2005

(54) SELECTOR SWITCH KNOB WITH LOCK RING ASSEMBLY

(75) Inventor: Andrew Adams Litteer, Clay, NY (US)

(73) Assignee: Cooper Industries, Inc., Houston, TX (US)

( * ) Notice: Subject to any disclaimer, the term of this patent is extended or adjusted under 35 U.S.C. 154(b) by 112 days.

(21) Appl. No.: 10/683,698

(22) Filed: Oct. 14, 2003

(51) Int. Cl.[7] ..... H01H 9/28; H01H 3/20

(52) U.S. Cl. ..... 200/43.01; 200/43.21; 200/321; 200/334; 200/566

(58) Field of Search ..... 200/11 R–11 TW, 200/43.01–43.22, 334–336, 500–574, 15, 200/17 R, 18; 29/622

(56) References Cited

U.S. PATENT DOCUMENTS

| | | | | |
|---|---|---|---|---|
| 3,384,727 A | * | 5/1968 | Zavertnik et al. | 200/43.11 X |
| 4,121,065 A | * | 10/1978 | Woodard | 200/43.01 |
| 4,280,028 A | * | 7/1981 | Hollenbeck, Jr. | 200/43.11 |
| 4,424,424 A | * | 1/1984 | Hollenbeck, Jr. | 200/43.08 |
| 4,748,297 A | * | 5/1988 | Sorenson et al. | 200/11 J |
| 6,567,264 B2 | * | 5/2003 | Megason | 200/43.08 X |

OTHER PUBLICATIONS

Catalog page for DSD Cover and Device Sub-Assemblies, 4C-9, Crouse-Hinds, copyright 1999 Cooper Industries, Inc. (1st Proof Apr. 19, 1999).

Catalog page for DSD Cover and Device Sub-Assemblies, 4C-11, Crouse-Hinds, copyright 2000 Cooper Industries, Inc.

Catalog page for EDS and EDSC Single and Multi-Gang Device Bodies and EFS and EFSC Single Gang Device Bodies, 4C-12, Crouse-Hinds, copyright 1999 Cooper Industries, Inc. (1st Proof Apr. 19, 1999).

Catalog page for EFS and EDS Factory Sealed Control Devices and Manual Motor Starting Switches, 5C-2, Crouse-Hinds, copyright 1999 Cooper Industries, Inc. (1st Proof Apr. 19, 1999).

* cited by examiner

*Primary Examiner*—James R. Scott
(74) *Attorney, Agent, or Firm*—Fish & Richardson P.C.

(57) ABSTRACT

A locking switch includes a shaft that engages one or more electromechanical switches and a knob that is secured to the shaft such that when the knob is rotated, a rotary motion is imparted to the shaft and to the electromechanical switches engaged by the shaft. The locking switch also includes a lock ring having multiple slots and a lock lever that is attached to the knob and that is captured in one of the slots in the lock ring to prevent rotation of the knob.

23 Claims, 6 Drawing Sheets

SELECTOR SWITCH KNOB WITH LOCK RING ASSEMBLY

TECHNICAL FIELD

This document relates to a selector switch knob with a lock ring assembly.

BACKGROUND

A selector switch may activate one or more electromechanical switches. It may be desirable to lock the selector switch in a certain position such that motion from that position is prohibited.

SUMMARY

In one general aspect, a locking switch includes a shaft and a knob. The shaft engages one or more electromechanical switches. The knob is secured to the shaft such that rotation of the knob imparts a rotary motion to the shaft and to the electromechanical switches engaged by the shaft. The locking switch also includes a lock ring having multiple slots and a lock lever that is attached to the knob and that is captured in one of the slots in the lock ring to prevent rotation of the knob.

Implementations may include one or more of the following features. For example, the knob may surround the lock ring, and may include a slit through which the lock lever is inserted and mounted within the knob. The shaft, the knob, the lock ring, and the lock lever may be separate components that are capable of being assembled to retrofit an installed switch.

The shaft may include a first flat area on an end of the shaft that fits within the knob to prevent rotation of the knob about the shaft. The shaft also may include a second flat area on an end of the shaft to engage the one or more electromechanical switches.

A fastener, such as a screw, may secure the knob to the shaft. The knob and the lock lever each may include a hole through which a pin is inserted to attach the lock lever to the knob.

The lock lever may include a machined feature that is captured in one of the slots of the lock ring to prevent rotation of the knob. The lock lever may include a hole to receive a locking device to prevent use of the switch. The lock lever may include a bent tab to provide a grip point on the lock lever.

The locking switch may include a bearing through which the shaft fits. The bearing may be secured in the lock ring, and may be threaded. A lock nut may secure the bearing within a cover. The locking switch may include a marking plate on which one or more positions of the switch may be marked.

In another general aspect, assembling a locking switch to an enclosure may include threading through an opening in a cover, a bearing assembly that includes a threaded bearing, a shaft, and a lock ring having multiple slots. A knob is attached to the shaft of the bearing assembly. The knob includes a lock lever that is inserted through a slit in the knob and is attached to the knob. A lock nut is attached over exposed bearing threads that protrude through the cover, and the cover is secured to the enclosure.

Implementations may include one or more of the following features. For example, the lock nut may be attached to a back of the cover with a fastener. The lock lever may be thrown such that the lock lever is captured in one of the slots to prevent rotation of the knob. A locking device may be inserted through an opening in the lock lever to prevent use of the locking switch. The knob may surround the bearing assembly. The shaft may engage with one or more electromechanical switches. The locking switch may be assembled to retrofit an installed switch.

Other features will be apparent from the description and drawings, and from the claims.

DESCRIPTION OF DRAWINGS

Like reference symbols in the various drawings indicate like elements.

DETAILED DESCRIPTION

A locking switch that activates one or more electromechanical switches is described. This mechanism uses a lockable rotary selector switch for activating one or more switches. When engaged, the lockout feature prevents motion of the selector switch. This locking action may be used, for example, to control the remote operation of equipment and to prevent users from turning on electrical equipment during preventative maintenance. Unlike conventional locking selector switches that only came pre-assembled from the manufacturer, this locking selector switch is available in a component form that may be assembled by the manufacturer at a manufacturing facility, by a distributor at a distribution facility, or by a consumer at a job site. The locking selector switch may be installed inside an enclosure or on a faceplate to activate a device inside the enclosure or behind the faceplate.

Figure 1:
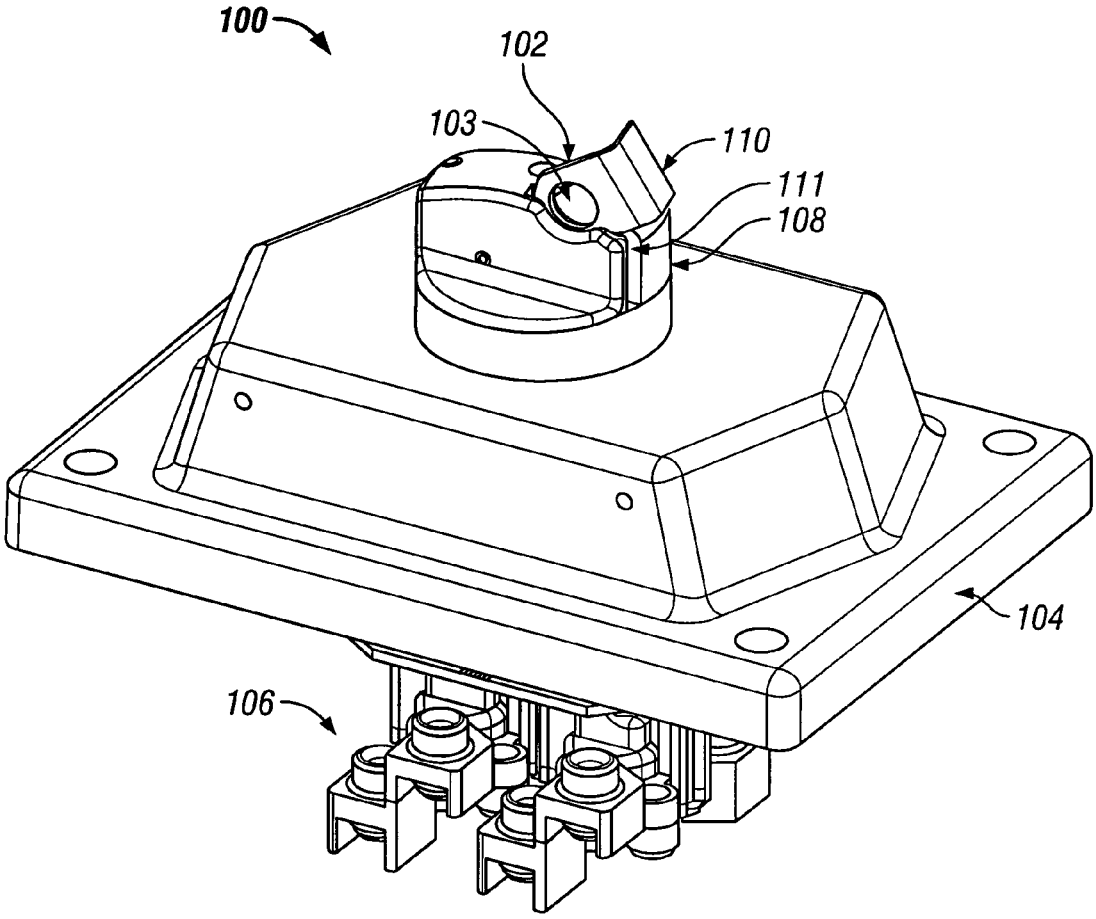
FIG. 1 is a perspective view of an electrical control station with a locking selector switch attached to a cover.

Referring to FIG. 1, an electrical control station ("control station") 100 is used to activate and monitor a set of electromechanical switches. The locking selector switch 102 is used to activate an electromechanical switch within the control station 100. The locking selector switch 102 can also be locked in certain positions by inserting a locking device (e.g., a locking hasp) into an opening 103 to prevent motion of the electromechanical switch.

The locking selector switch 102 is attached to the cover 104 of the control station 100, and the electromechanical switch 106 is behind the cover 104. The electrical contacts between the control station 100 and the rest of the system are made at the electromechanical switch 106. The electromechanical switch 106 may be a contact block, an explosion proof switch, a rotary switch, a cam mechanism, or any other device capable of receiving a rotational input.

The electromechanical switch 106 is controlled by the locking selector switch 102. To this end, the locking selector switch 102 and the electromechanical switch 106 are connected by a shaft. Rotating the locking selector switch 102 causes rotation of the shaft, which, in turn, causes a response in the electromechanical switch 106.

A knob 108 is used to rotate the locking selector switch 102. The knob 108 is connected to the shaft that connects to the electromechanical switch 106. As a result, rotating the knob 108 activates the electromechanical switch. The knob 108 can have a molded feature that indicates the relationship between the position of the knob 108 and the position of the shaft and the electromechanical switch.

Attached to the inside of the knob 108 is the lock lever 110. Raising the lock lever 110 causes the locking selector switch 102 to be held in its current position, and thereby prevents changes to the current state of the electromechanical switch 106. The lock lever 110 fits through a slit 111 in the top of the knob 108. The lock lever 110 is also attached to the knob 108 with a pin about which the lock lever 110 rotates. Therefore, rotating the knob 108 also rotates the lock lever 110.

Figure 2:
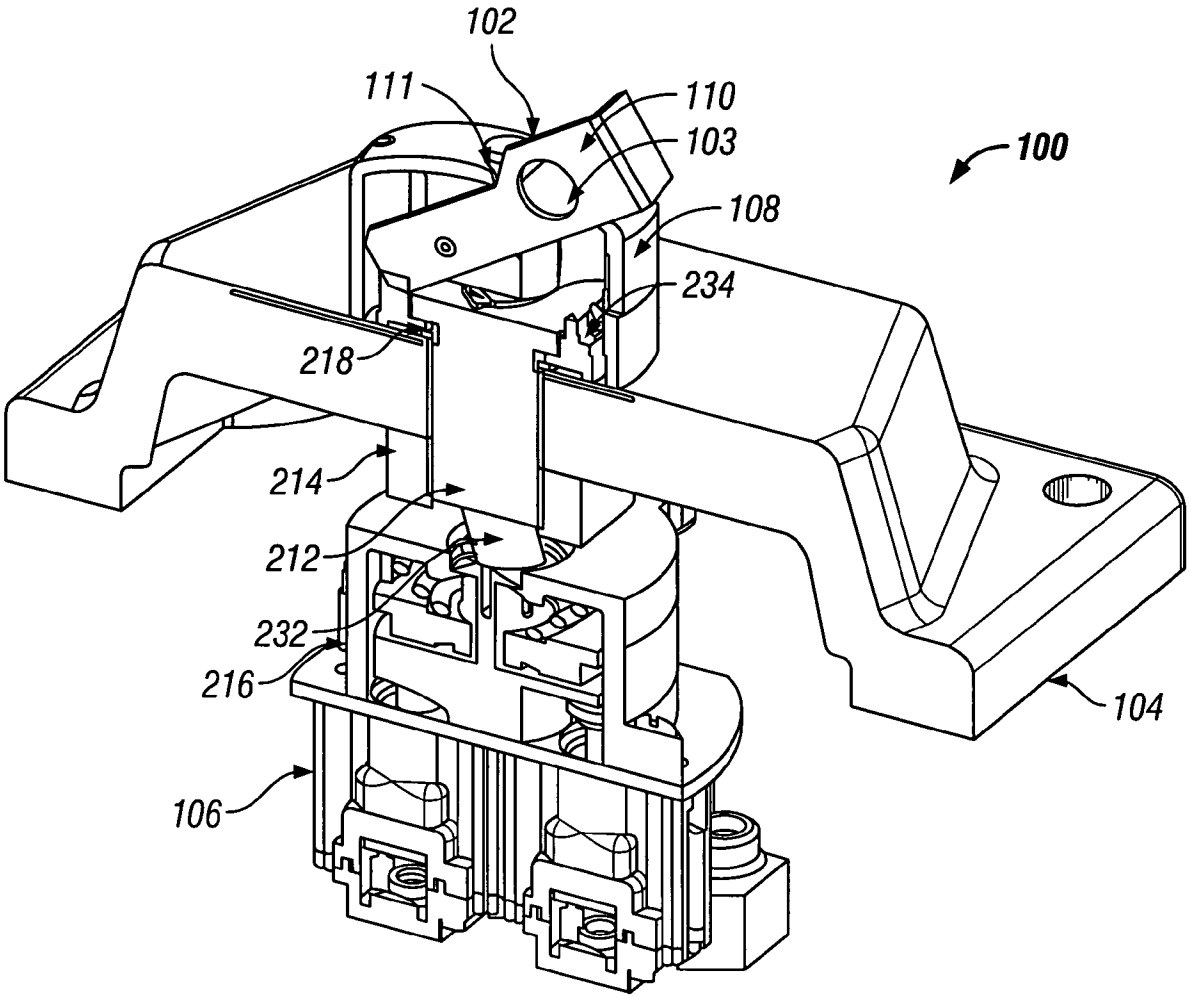
FIG. 2 is a cross sectional view of the electrical control station of FIG. 1.

Referring to FIG. 2, a cross sectional view of the control station 100 reveals the inner components of the locking selector switch 102. The different components attach to the cover 104 of the control system 100. When assembled, the components of the locking selector switch 102 activate the electromechanical switch 106.

Turning the knob 108 on the outside of the cover 104 activates the electromechanical switch 106 on the opposite side of the cover 104. After turning the knob 108, the lock lever 110, which fits through slit 111 in the knob 108, can be lifted to lock the knob in its current position. Since motion in the knob 108 causes a response in the electromechanical switch 106, engaging the lock lever 110 also prevents the state of the electromechanical switch 106 from changing. The lock lever 110 fits into slots 234 on a bearing assembly 212. When the lock lever 110 is down in one of the slots 234, movement of the knob 108 is prevented by interaction of the lock lever with the slot 234. In particular, rotating the knob 108 while the lock lever 110 is down in one of the slots 234 of the bearing assembly 212 causes the lock lever 110 to hit the sides of the currently-occupied slot. Because the bearing assembly 212 is affixed to the cover 104 and cannot move, the lock lever 110 cannot move past the currently-occupied slot, and the knob 108 cannot rotate past its current position. In other words, the knob 108 and, consequently, the electromechanical switch 106 are locked in their current positions when the lock lever 110 is down.

The bearing assembly 212 fits through a hole 218 in the cover 104. The outside of the bearing assembly 212 may be threaded, as may the inside of the hole 218 in the cover 104. When threaded, the bearing assembly 212 is screwed down into the hole 218 in the cover 104 until the top of the bearing assembly is against the front side of the cover 104. Since the length of the bearing assembly 212 is greater than the thickness of the cover 104, the threads at the bottom of the bearing assembly are exposed on the back side of the cover 104 when the bearing assembly 212 is fully screwed into the cover 104. A lock nut 214 is attached to the exposed threads of the bearing assembly 212. The lock nut 214 locks the threads of the bearing assembly 212 into the cover and holds the bearing assembly in place to prevent the bearing assembly 212 from rotating against pressure from the lock lever 110.

The bearing assembly 212 also contains a shaft 232 that connects to the knob 108 at one end and to an exemplary operator module 216 at the other. In one exemplary implementation, the operator module 216 directly connects to the electromechanical switch to be controlled. The operator module 216 activates the electromechanical switch to which it is connected based on the rotation of the input shaft 232. Rotating the knob 108 causes the shaft 232 to rotate within the operator module 216. This rotation causes the operator module 216 to activate the electromechanical switch 106. The operator module 216 is optional when the electromechanical switch to be controlled can directly accept the rotational input of the shaft 232.

Figure 3:
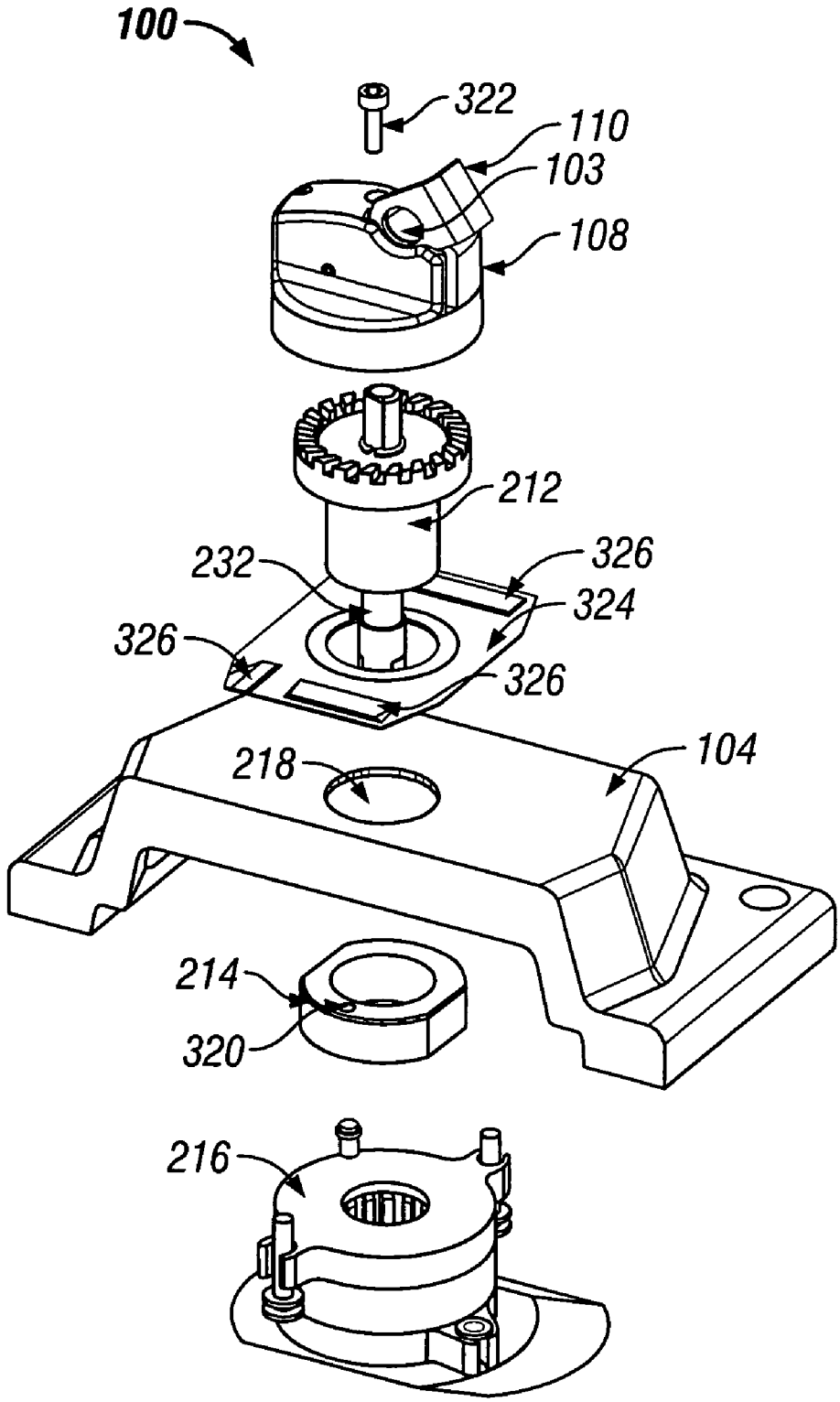
FIG. 3 is an exploded view of the electrical control station of FIG. 1.

Referring to FIG. 3, an electrical control station 100 may contain a locking selector switch that includes modular components that can be assembled outside of the manufacturing site. The locking selector switch is attached to the cover 104 of the control station 100. The knob 108 is used to control an electromechanical switch (not shown) in the control station 100, and the lock lever 110 is used to hold the electromechanical switch in certain positions. The lock lever 110 interacts with the bearing assembly 212 that fits down through a hole 218 in the cover 104. The lock nut 214 is attached to the part of the bearing assembly 212 that is exposed on the back side of the cover 104. A set screw is driven through a hole 320 in the lock nut 214 to attach the lock nut 214 to the back of the cover 104. This, in turn, holds the bearing assembly 212 in place and prevents the bearing assembly from rotating against pressure from the lock lever 110.

In one exemplary implementation, the operator module 216 is connected to the shaft 232 of the bearing assembly 212. The rotation of the shaft 232 caused by rotation of the knob 108 is used by the operator module 216 to activate an electromechanical switch to which the operator module 216 is connected. A screw 322 is used to attach the knob 108 to the shaft 232 of the bearing assembly 212. Attaching the knob 108 to the shaft allows rotation of the knob to control the electromechanical switch in the control station 100.

In one exemplary implementation, a optional marking plate 324 may be included in the locking selector switch. The marking plate 324 fits against the cover 104, and is held in place by the top of the bearing assembly 212 after the bearing assembly 212 has been screwed down through the hole 218 in the cover 104. Markings indicating the position of the locking selector switch may be placed in multiple areas on the marking plate 324. For instance, three areas 326 may be used to indicate the position of the locking selector switch on the marking plate 324. These markings may be laser etched or stamped onto the areas 326 on the marking plate 324.

Figure 4:
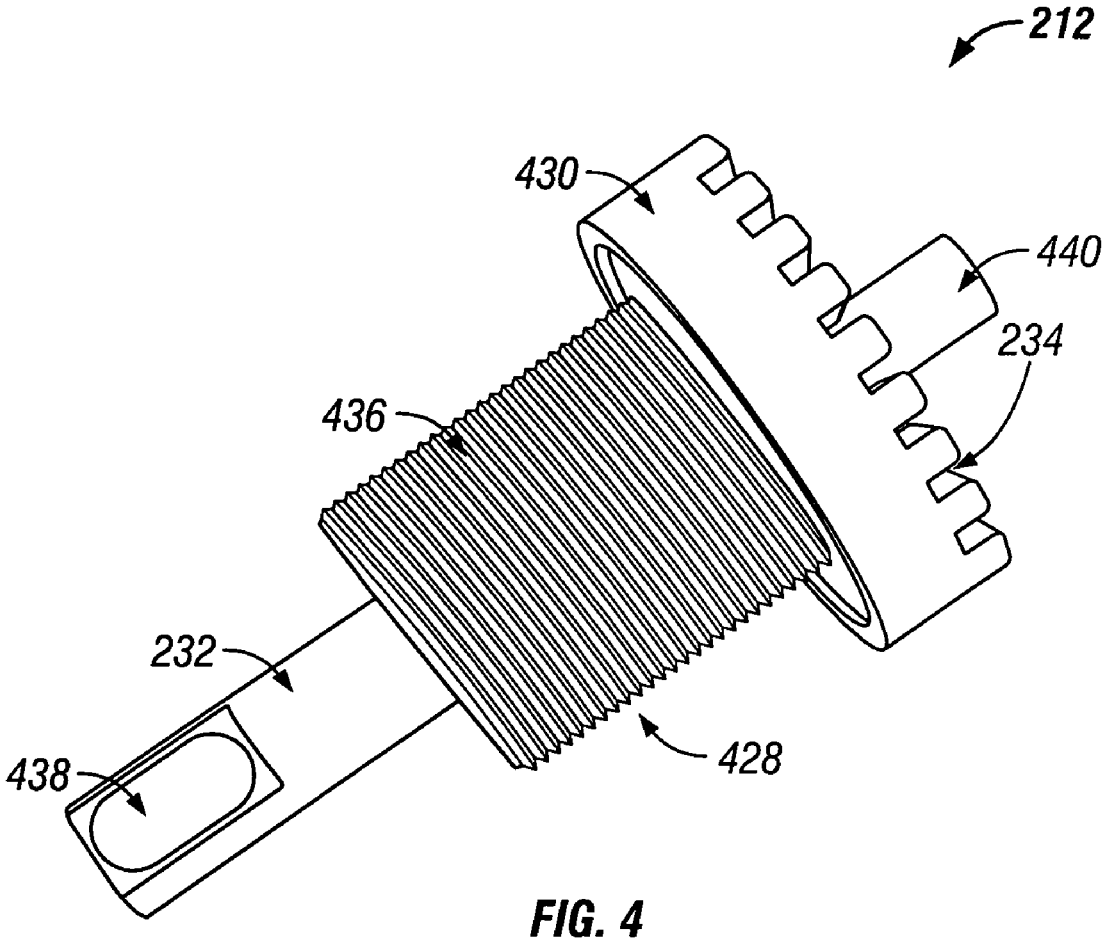
FIG. 4 is an illustration of a bearing assembly of the locking selector switch of FIG. 1.

Referring to FIG. 4, the bearing assembly 212 of a locking selector switch includes a threaded bearing 428, a lock ring 430, and a shaft 232. The lock ring 430 includes a number of slots 234 that are cast or machined into its surface to provide a landing surface for the lock lever 110 when the lock is operated. The slots 234 in the lock ring 430 are aligned with the lock lever 110 and can vary in width to allow for a finer or coarser resolution of the possible locking positions. These slots 234 can also vary in number and location to allow the lock lever 110 to be locked only in specific orientations. In situations where the lock ring 430 contains more slots than there are distinct positions of the electromechanical switch, this arrangement of slots 234 in the lock ring 430 allows the locking selector switch 100 to be assembled into an enclosure or faceplate without aligning the switch mechanism to the electromechanical switches. Multiple slots 234 in the lock ring 430 may correspond to an approximate position of the electromechanical switch. As any of these slots 234 can be used to lock the electromechanical switch in the desired position, the alignment of the lock ring relative to the electromechanical switch is flexible.

The bearing 428 fits through the center of the lock ring 430. The bearing 428 has threads 436 on its outside that mate with threads in the hole 218 in the control station cover through which the locking selector switch is assembled. The threads 436 are also used to attach a lock nut to the bearing 428 to hold the entire bearing assembly 212 in place. A shorter bearing may be used such that there are no threads exposed on the back side of the cover, thus making the lock nut optional.

The shaft 232 fits through the center of the bearing 428. The shaft 232 connects the knob 108 to the operator module and its associated electromechanical switch such that rotating the knob causes a response in the electromechanical switch. The shaft 232 includes a flat area 438 that fits against a flat area in the operator module such that the input shaft 232 does not rotate within the operator module without being detected. A second flat area 440 at the bottom of the shaft 232 engages a flat area in the knob such that the knob does not rotate about the shaft 232.

Figure 5B:
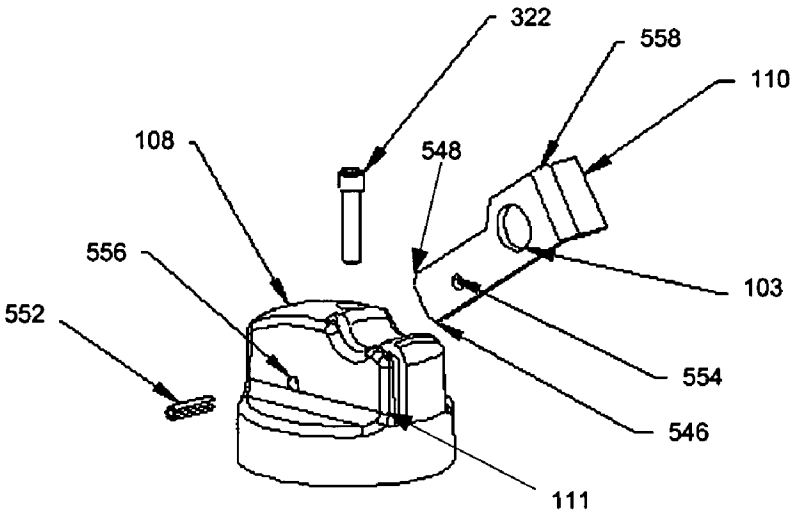
FIG. 5B is an exploded view of the handle and lock lever of the locking selector switch of FIG. 1.
Figure 5A:
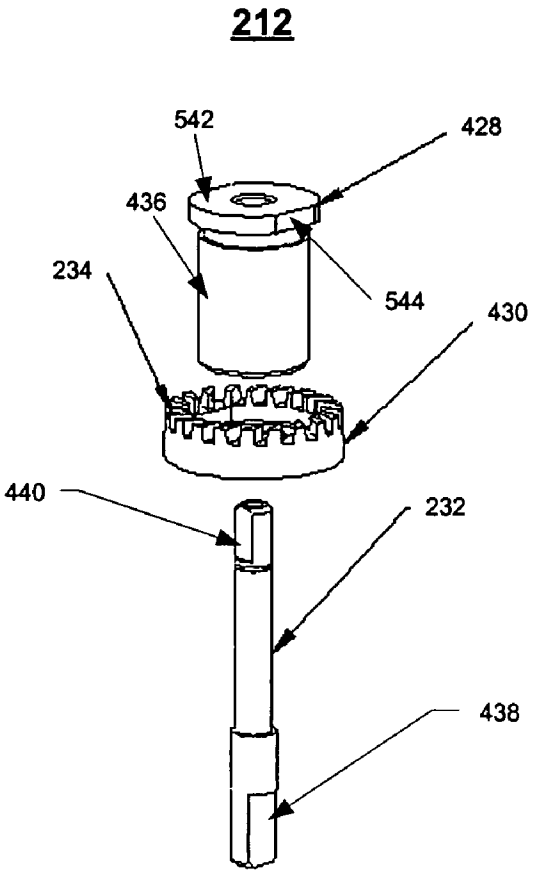
FIG. 5A is an exploded view of the bearing assembly of FIG. 4.

Referring to FIG. 5A, the bearing assembly 212 includes three parts that fit within one another. The threaded bearing 428 fits within the lock ring 430, and the shaft 232 fits inside the bearing 428. The lock ring contains slots 234 that capture the lock lever 110 and prevent the selector switch from moving when the lock lever 110 is engaged. The bearing 428 includes threads 436 that allow it to be screwed into a hole 218 in the cover 104 of the control station into which the locking selector switch is being assembled. The shaft 232 also contains a flat area 438 that allows the shaft 232 to engage the electromechanical switch, either directly or indirectly through an operator module. A second flat area 440 on the shaft 232 engages the knob and prevents the knob from rotating about the shaft 232.

A lip 542 at the top of the bearing 428 fits on a corresponding lip in the lock ring 430. There are flat areas 544 on the lip 542 of the bearing 428 that fits with corresponding flat areas in the lip of the lock ring 430. This arrangement allows for the bearing 428 and the lock ring 430 to fit together and move as one piece when the locking selector switch is assembled. It also allows the bearing 428 to hold the lock ring 430 in place after assembly such that the ring does not rotate against pressure from the lock lever 110, making other methods for affixing the lock ring 430 to the desired surface unnecessary. The bearing may be optional in cases where other methods for affixing the lock ring to the desired surface, such as a large rivet, are used.

Referring to FIG. 5B, the knob 108 and the lock lever 110 of the locking selector switch are used to control an electromechanical switch. The knob 108 changes the position of the locking selector switch, while the lock lever 110 holds the locking selector switch in certain positions.

Moving the lock lever 110 into the locked position will insert the machined feature 546 of the lock lever 110 into one of the slots in the lock ring. This, in turn, prevents the knob 108 and the shaft from rotating, which locks any device affixed to the shaft in the desired position. The lock lever is loosely held in place as a result of friction between the corner 548 of the lock lever 110 and the inside of the knob 108. Moving the lock lever 110 into the locked position causes the corner 548 of the lock lever 110 to rub against the inside of the knob 108, thus holding the lock lever 110 in place. When the lock lever 110 is not in the locked position, there is no contact between the corner 548 of the lock lever 110 and the inside of the knob 108. Another benefit of the contact between the corner 548 of the lock lever 110 and the inside of the knob 108 is that this contact prevents the lock lever 110 from rotating all the way around.

When the lock lever 110 is engaged with the lock ring, an opening 103 in the lock lever 110 becomes exposed. This opening 103 allows the user to fasten a locking device, such as, for example, a padlock, to the lock lever 110 to hold the lock lever 119 in the locked position.

The lock lever 110 is attached to the inside of the knob 108 with a pin 552. The pin 552 fits through a hole 554 in the lock lever 110 and a pair of holes 556 in the knob 108. This arrangement allows the lock lever 110 to rotate about the pin 552 to engage the lock ring. The location of the hole 554 in the lock lever 110 and the holes 556 in the knob 108 can be adjusted to modify the length of the throw of the lock lever 110.

The lock lever 110 also contains a bent tab 558 that the user grabs when moving the lock lever 110. The length of the bent tab 558 can be increased to provide a better grip to the user of the locking selector switch. Similarly, the length of the lock lever 110 itself can be adjusted to provide different amounts of leverage to the user. The lock lever 110 fits through a slit 111 in the knob 108 that allows the lock lever 110 to access the lock ring, which is positioned under the knob 108. The screw 322 is used to attach the knob 108 to the shaft. The screw 322 is driven straight though the top of the knob 108 and into the top of the shaft to securely attach the knob 108 to the shaft.

Figure 6:
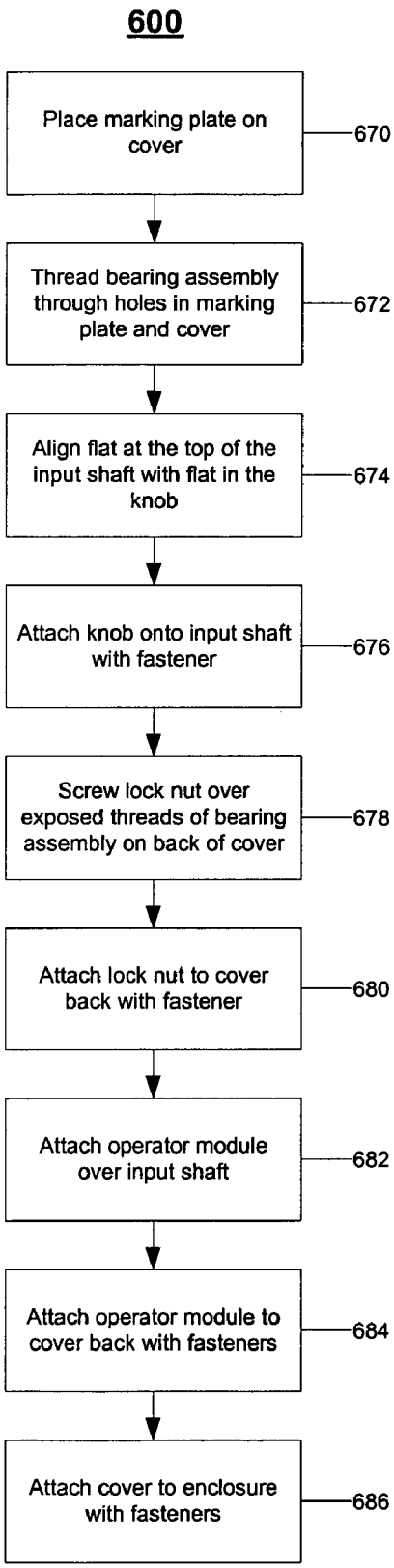
FIG. 6 is a flow chart of a process for assembling a locking selector switch on an electrical control station.

Referring to FIG. 6, an assembly process 600 can be used to assemble the modular components of the locking selector switch onto a cover of a control station. The assembly process can be performed in the factory where the components are created, at a distributor where the components are sold, or on a job site where the components are used. The assembly process is shorter than previous assembly processes, and therefore results in an overall cost savings.

If an optional marking plate is to be used, the first step in the assembly is to place the marking plate onto the front side of the cover in the proper orientation (670). The marking plate indicates the current position of the switch, and must be properly oriented relative to the switch. Next, the bearing assembly is threaded through the holes in the marking plate and the cover (672). The inside of the hole in the cover is threaded, as is the outside of the bearing assembly, so the bearing assembly can be screwed down through the hole in the cover. The bearing assembly is screwed down until there is a tight fit between the top of the bearing and the cover. Because the length of the bearing assembly is greater than the thickness of the cover, the threads at the bottom of the bearing assembly are exposed on the back side of the cover after the bearing assembly has been adequately tightened.

The flat area at the top of the shaft in the bearing assembly is then aligned with the flat area on the underside of the knob (674). Having flat areas on the input shaft and the knob ensures that the knob does not rotate about the input shaft and that turning the knob turns the input shaft. A fastener (e.g., a screw) is driven through the top of the knob into the top of the input shaft to hold the knob and the input shaft together (676).

On the back of the cover, the lock nut is attached to the exposed threads of the bearing assembly on the back side of the cover (678). The lock nut is then attached to the back of the cover with a fastener (e.g., a set screw) (680). These two steps lock the bearing assembly to the cover such that the input shaft is the only part of the bearing assembly that can rotate or move.

The next step in the assembly process 600 is to attach the operator module over the input shaft on the back side of the cover (682). To hold the operator module in place, the operator module is attached to the cover with fasteners (e.g., screws) (684). The operator module comes attached to the electromechanical switch that it controls, so attaching the operator module to the cover also attaches the electromechanical switch to the cover. Finally, the cover and all of the components that have been added to it are placed into the enclosure of the control station, and the cover is attached to the enclosure with fasteners (e.g., screws) (684).

This modular locking selector switch that can be assembled in the field has several advantages over conventional pre-assembled locking selector switches. For example, the locking selector switch can be adjusted to function better in its environment for its users. Providing the locking selector switch in component form also costs less than the pre-assembled locking selector switches. Components can be reused from other devices without modification. In addition, assembly costs are lower because the assembly takes less time and may not even occur in the factory. Finally, the locking function is more flexible and easier to use than that of conventional locking selector switches, which generally could only be locked in one position.

It will be understood that various modifications may be made without departing from the spirit and scope of the claims. For example, advantageous results still could be achieved if components in the disclosed systems were combined in a different manner and/or replaced or supplemented by other components. Accordingly, other implementations are within the scope of the following claims.

What is claimed is:

1. A locking switch, comprising:

a shaft that engages one or more electromechanical switches;

a knob that is secured to the shaft such that when the knob is rotated, a rotary motion is imparted to the shaft and to the electromechanical switches engaged by the shaft;

a lock ring having multiple slots; and a lock lever that is attached to the knob and that is captured in one of the slots in the lock ring to prevent rotation of the knob.

2. The switch of claim 1 wherein the knob surrounds the lock ring.

3. The switch of claim 1 wherein the knob includes a slit through which the lock lever is inserted and mounted within the knob.

4. The switch of claim 1 wherein the shaft, the knob, the lock ring, and the lock lever are separate components that are capable of being assembled to retrofit an installed switch.

5. The switch of claim 1 wherein the shaft includes a first flat area on an end of the shaft that fits within the knob to prevent rotation of the knob about the shaft.

6. The switch of claim 1 wherein the shaft includes a second flat area on an end of the shaft to engage the one or more electromechanical switches.

7. The switch of claim 1 further comprising a fastener that secures the knob to the shaft.

8. The switch of claim 7 wherein the fastener includes a screw.

9. The switch of claim 1 wherein the knob and the lock lever each include a hole through which a pin is inserted to attach the lock lever to the knob.

10. The switch of claim 1 wherein the lock lever includes a machined feature that is captured in one of the slots of the lock ring to prevent rotation of the knob.

11. The switch of claim 1 wherein the lock lever includes a hole to receive a locking device to prevent use of the switch.

12. The switch of claim 1 wherein the lock lever includes a bent tab to provide a grip point on the lock lever.

13. The switch of claim 1 further comprising a bearing, wherein the shaft fits through the bearing and the bearing is secured in the lock ring.

14. The switch of claim 13 wherein the bearing includes a threaded bearing.

15. The switch of claim 13 further comprising a lock nut to secure the bearing within a cover.

16. The switch of claim 1 further comprising a marking plate on which one or more positions of the switch may be marked.

17. A method for assembling a locking switch to an enclosure, the method comprising:

threading a bearing assembly through an opening in a cover, wherein the bearing assembly includes a threaded bearing, a shaft, and a lock ring having multiple slots;

attaching a knob to the shaft of the bearing assembly, wherein the knob includes a lock lever inserted through a slit in the knob and attached to the knob;

attaching a lock nut over exposed bearing threads that protrude through the cover; and securing the cover to an enclosure.

18. The method as in claim 17 further comprising attaching the lock nut to a back of the cover with a fastener.

19. The method as in claim 17 further comprising throwing the lock lever such that the lock lever is captured in one of the slots to prevent rotation of the knob.

20. The method as in claim 19 further comprising inserting a locking device through an opening in the lock lever to prevent use of the locking switch.

21. The method as in claim 17 wherein attaching the knob to the shaft includes surrounding the bearing assembly with the knob.

22. The method as in claim 17 further comprising engaging the shaft with one or more electromechanical switches.

23. The method as in claim 17 wherein threading the bearing assembly, attaching the knob, attaching the lock nut, and securing the cover is to retrofit an installed switch.

* * * * *